US006962261B2

(12) United States Patent
White

(10) Patent No.: US 6,962,261 B2
(45) Date of Patent: Nov. 8, 2005

(54) SYSTEM FOR FRONTAL DISPLAY OF OBJECTS

(76) Inventor: Michael J. White, 301 E. Wall St., Grapevine, TX (US) 76051

( * ) Notice: Subject to any disclaimer, the term of this patent is extended or adjusted under 35 U.S.C. 154(b) by 38 days.

(21) Appl. No.: 10/443,933

(22) Filed: May 22, 2003

(65) Prior Publication Data

US 2003/0218034 A1 Nov. 27, 2003

Related U.S. Application Data

(60) Provisional application No. 60/382,326, filed on May 22, 2002.

(51) Int. Cl.[7] ..... A47F 5/08
(52) U.S. Cl. ..... 211/113; 211/183
(58) Field of Search ..... 24/116, 113, 118, 24/123; 223/85, 91, 92, 94, 96, 89; 211/113, 211/116, 118, 123, 183

(56) References Cited

U.S. PATENT DOCUMENTS 902,078 A * 10/1908 Hawley et al. ..... 223/92
2,458,820 A * 1/1949 Zimmermann ..... 211/113
2,801,036 A * 7/1957 Klein ..... 223/92
3,228,738 A * 1/1966 Koffler ..... 206/284
3,386,589 A * 6/1968 Prete, Jr. ..... 211/118
3,480,245 A * 11/1969 Gingher ..... 248/317
3,568,852 A 3/1971 Howard
3,963,154 A * 6/1976 Schwartz et al. ..... 223/85
3,984,002 A 10/1976 Howard
3,991,884 A * 11/1976 DeMaagd et al. ..... 211/1.51
4,006,547 A * 2/1977 Samuels et al. ..... 40/322
4,034,902 A * 7/1977 Grillo ..... 223/85
4,074,838 A * 2/1978 Blasnik et al. ..... 223/85
4,123,864 A * 11/1978 Batts et al. ..... 40/322
4,185,768 A * 1/1980 Treiman ..... 223/85
4,187,967 A * 2/1980 Garrison ..... 223/92
4,193,504 A 3/1980 Berkowitz
4,312,464 A * 1/1982 Treiman ..... 223/85
4,361,241 A 11/1982 Stoddard
4,548,328 A 10/1985 Brauning
4,586,524 A * 5/1986 Smith ..... 135/16
4,760,929 A * 8/1988 Fedorchak ..... 211/123
4,921,098 A 5/1990 Combier et al.
4,997,114 A 3/1991 Petrou
5,397,037 A * 3/1995 Ozawa ..... 223/94
5,503,010 A 4/1996 Yamanaka
5,601,219 A * 2/1997 Chen ..... 223/85
5,645,200 A * 7/1997 McDowell et al. ..... 223/89
5,647,492 A 7/1997 Fillios et al.
5,746,360 A * 5/1998 Chen ..... 223/85
5,775,554 A * 7/1998 Taylor ..... 223/96
5,881,931 A 3/1999 Stanfield
6,006,964 A 12/1999 White
6,032,838 A * 3/2000 Maher ..... 223/85
6,170,679 B1 1/2001 Frye et al.
6,409,057 B1 * 6/2002 Kim ..... 223/85
6,726,067 B2 4/2004 Louw

* cited by examiner

*Primary Examiner*—Jennifer E. Novosad
(74) *Attorney, Agent, or Firm*—Wei Wei Jeang; Haynes and Boone LLP

(57) ABSTRACT

In accordance with an embodiment of the present invention, a hanger comprises a main body disposed in a first plane and a swivel hook coupled to the main body such that the main body and the hook maintain a desired planar relationship with each other.

35 Claims, 7 Drawing Sheets

SYSTEM FOR FRONTAL DISPLAY OF OBJECTS

RELATED APPLICATIONS

This patent application claims the benefit of Provisional Patent Application Ser. No. 60/382,326, entitled System for Frontal Display of Objects, filed on May 22, 2002, the disclosure of which is incorporated herein by reference. This patent application is related to patent application Ser. No. 10/414,841, entitled System for Frontal Display of Objects, filed on Apr. 16, 2003; and patent application Ser. No. 10/417,060, entitled System for Frontal Display of Objects, filed on Apr. 16, 2003; the disclosures of all of which are incorporated herein by reference.

TECHNICAL FIELD OF THE INVENTION

The present invention relates generally to the display of objects, and more particularly to a system for frontal display of objects.

BACKGROUND OF THE INVENTION

In existing systems for displaying objects, such as garments, ties, mats, towels, linen, etc., the objects are hung or clipped to hangers which are suspended from display bars. Such a system 10 is shown in FIG. 1A in which a plurality of objects 12 are hung on conventional hangers and suspended from a rod 14. A conventional hanger comprises of a hook and a main body. The hook comprises of two portions—a top portion that interfaces with the display bar and a bottom portion that interfaces with the main body of the hanger. The top portion of the hook is circular in shape. Thus, the hanger contacts a round display bar at only one contact point causing the hanger to be unstable when an object is suspended from it. When these hangers are hung on rod 14, only the narrow sides of the objects are exposed for viewing. As a result, customers or users of such display systems are unable to view the front of the objects with ease. The user has to use effort to part the objects to expose the front of a particular object for viewing. Therefore, much of the characteristics of the object, such as collar style, shape of the neck opening, the style of the fastener used, and design elements that are located on the front and back of a garment, for example, are not easily seen by the user. This is especially disadvantageous in a retail setting, where shoppers have to spend a lot of time and effort to shift the hangers on the rod to get a full view of the object.

FIG. 1B is a bottom plan view of prior art object display system 10. Because the conventional hangers and display rod 14 are perpendicular to each other, the floor space required for hanging objects using prior art object display system 10 is at least as wide as the width W1 of the hangers.

SUMMARY OF THE INVENTION

In accordance with an embodiment of the present invention, a hanger comprises a main body disposed in a first plane and a swivel hook coupled to the main body such that the main body and the hook maintain a desired planar relationship with each other.

In accordance with another embodiment of the present invention, an object display system comprises a display bar and a plurality of hangers suspended from the display bar, wherein at least one of the plurality of hangers comprises a main body disposed in a first plane and a swivel hook coupled to the main body such that the main body and the hook maintain a desired planar relationship with each other.

Other aspects and features of the invention will become apparent to those ordinarily skilled in the art upon review of the following description of specific embodiments of the invention in conjunction with the accompanying figures.

BRIEF DESCRIPTION OF THE DRAWINGS

For a more complete understanding of the present invention, the objects and advantages thereof, reference is now made to the following descriptions taken in connection with the accompanying drawings in which.

DETAILED DESCRIPTION OF THE DRAWINGS

The preferred embodiment of the present invention and its advantages are best understood by referring to FIGS. 1A through 15B of the drawings.

Figure 2A:
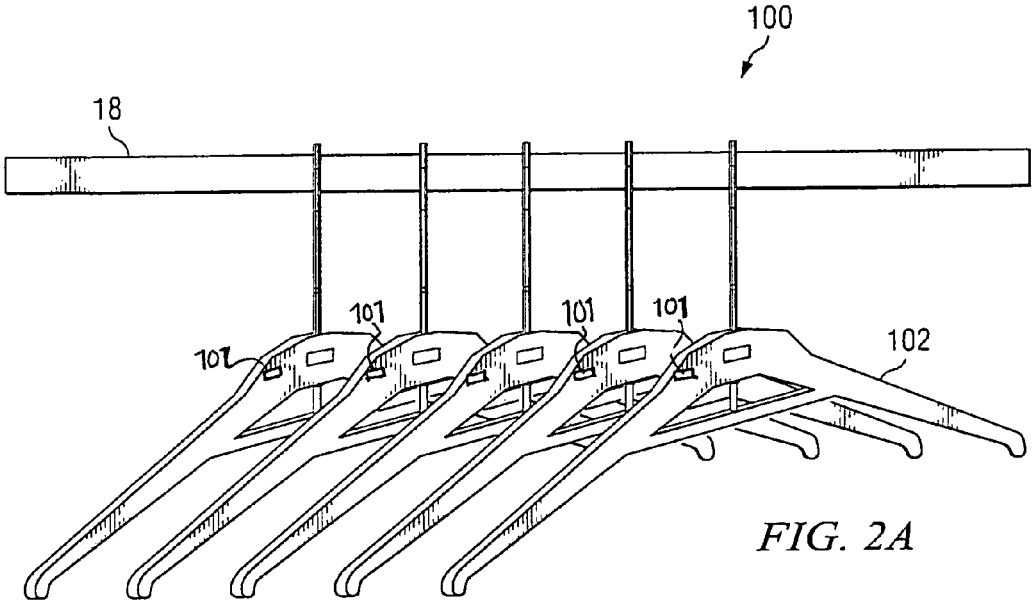
FIGS. 2A and 2B are front elevational views of a system for frontal display of objects in accordance with an embodiment of the present invention.
Figure 2B:
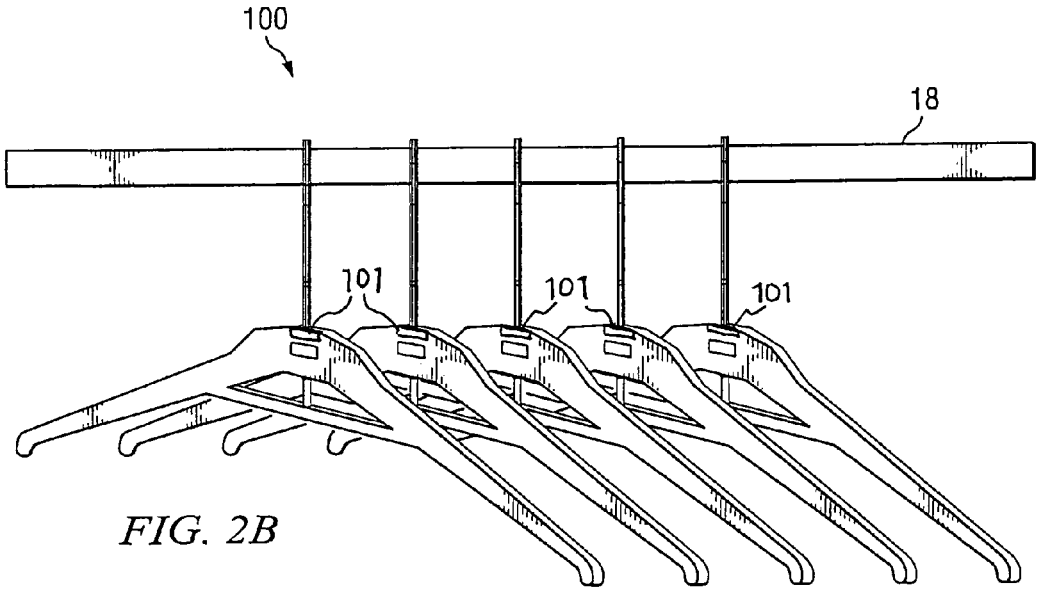

FIGS. 2A and 2B are front elevational views of a system 100 for frontal display of objects in accordance with an embodiment of the present invention, in which at least a portion of the front of each object on display is visible. In accordance with an embodiment of the present invention, a hanger 102 is disclosed, which when used to hang an object, for example a garment, from a display bar or rod 18, orients the object at an angle with respect to display bar 18. Thus, when multiple hangers, each with an object hung from it, are suspended from display bar 18, at least a portion of the front of each of the objects is simultaneously visible to the user. The hung objects are oriented by the hangers at an angle to display bar 18 and overlap slightly to allow a portion of the garments' front to be viewed simultaneously. This provides sufficient additional information about the objects on display to the users and the users do not need to rearrange each object in order to see its characteristics clearly.

The hanger may comprise of one or more slots. The slots may be provided on the main body of the hanger and may be used to removably couple one or more informational tags 101 to the hanger for fast and easy identification of information, such as brand, size, price, style, color and/or other information. The tag 101 may be a push tag and may comprise one or more tabs that may be inserted in the slots. If desired, the tag 101 may be fastened to the slots using some other means. Because the hanger has a front exposed portion, the slot may be provided on the exposed portion and the tag 101 placed thereon to allow simultaneous viewing of the informational tags provided on a plurality of hangers hanging from a display bar.

In accordance with an embodiment of the present invention, the hangers may be used for left-handed (FIG. 2A) and/or right-handed (FIG. 2B) display of objects to correspond with the requirements for displaying objects that may be used in different retail outlets, countries, distributors, manufacturers, and/or the like. In the preferred embodiment, the hanger is made of plastic using injection molding. If desired, other manufacturing methods and/or materials, such as metal, wood, and/or a composite of materials may be used for making the hanger.

Figure 1A:
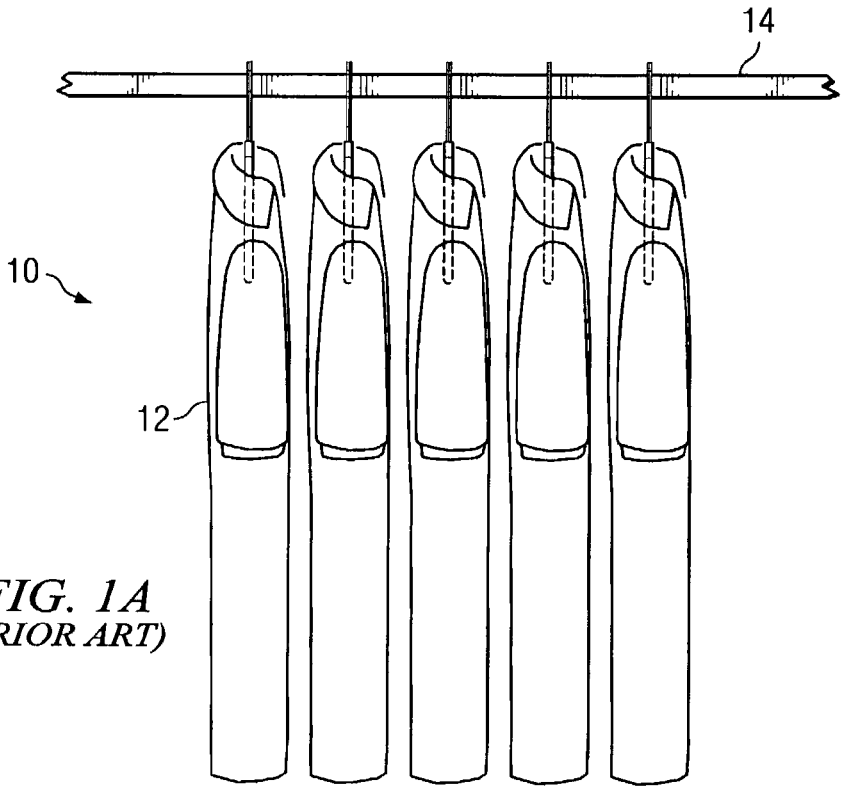
FIG. 1A (PRIOR ART)
FIG. 1A illustrates a prior art object display system.
Figure 1B:
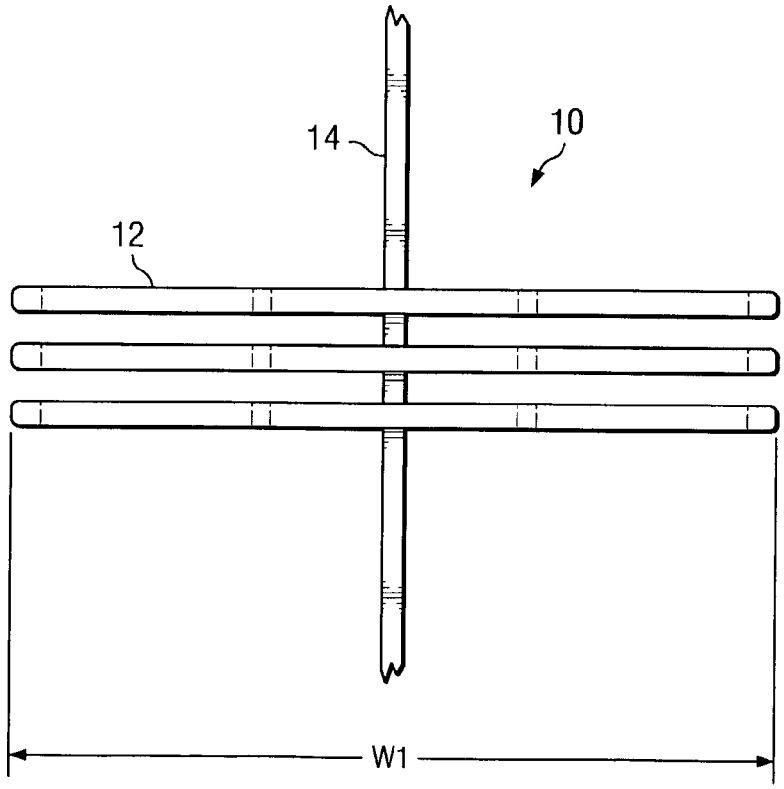
FIG. 1B (PRIOR ART)
FIG. 1B is a bottom plan view of the prior art object display system of FIG. 1A.
Figure 2C:
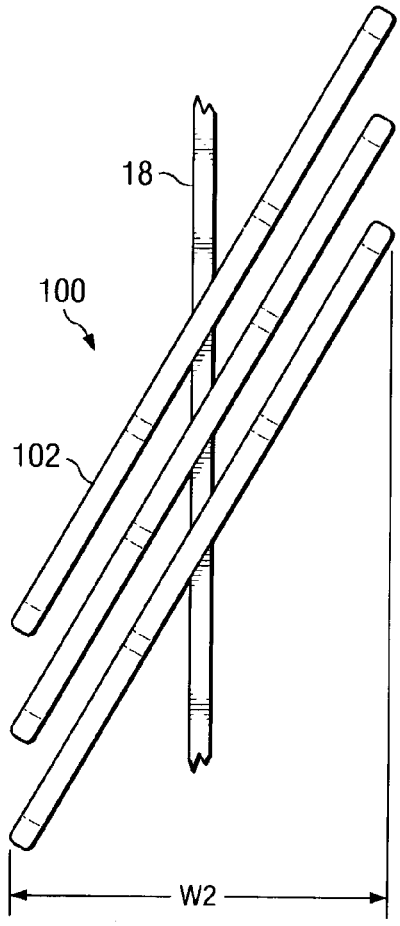
FIG. 2C is a bottom plan view of an object display system in accordance with an embodiment of the present invention.

FIG. 2C is a bottom plan view of object display system 100. As illustrated in FIG. 2C, a plurality of hangers 102 are suspended from display bar 18 such that the hangers are oriented at an angle other than ninety degrees with respect to display bar 18. Because the hangers are oriented at an angle, the floor space required for hanging objects on display bar 18 is less than the width of the hangers, W1 (FIG. 1B). In the embodiment of FIG. 2C, the width of the required floor space for hangers 102 is W2, where W2<W1.

Figure 2D:
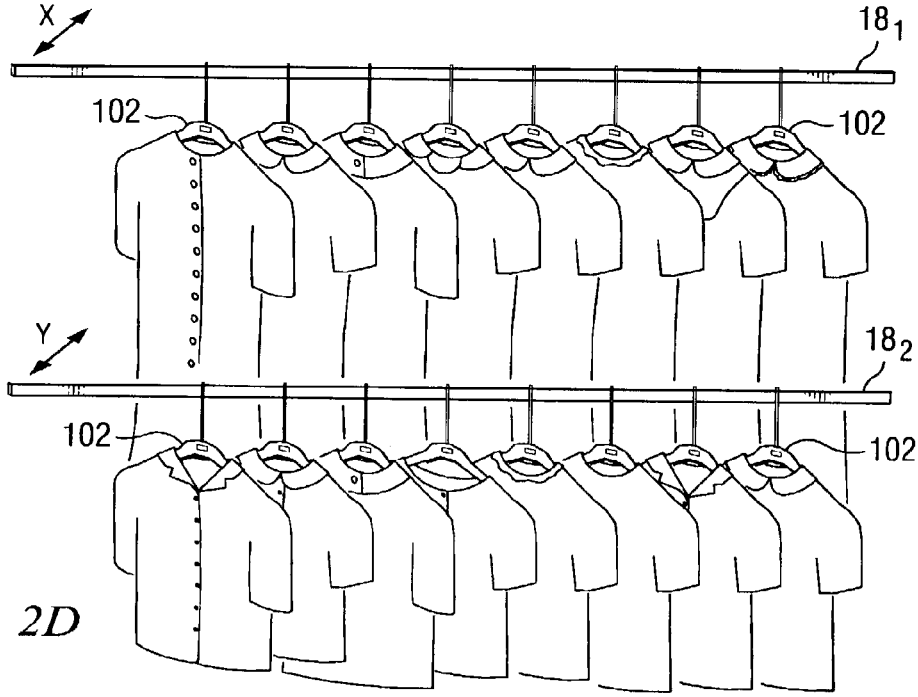
FIG. 2D is a front elevational view of the object display system of FIG. 2C.

FIG. 2D is a front elevational view of object display system 100. It may be seen that display bars using hanger 102 may be affixed closer to a wall than when conventional hangers are used. This is especially useful in closets or rooms where limited space is available for hanging and storing objects. Moreover, because the display bar may be placed closer to the wall, more than one display bar may be placed along the same wall. For example, as illustrated in FIG. 2D, a first display bar $\mathbf{18}_1$ may be placed closer to the wall at a distance X than a second display bar $\mathbf{18}_2$ which is located at a distance Y from the wall, wherein Y is still less than W1, the width of a hanger. First display bar $\mathbf{18}_1$ may also be placed higher than second display bar $\mathbf{18}_2$. Thus, longer objects, such as dresses and gowns, may be displayed on the first display bar $\mathbf{18}_1$, and shorter objects, such as shirts, blouses and pants, may be displayed on the second and lower display bar $\mathbf{18}_2$.

Figure 3A:
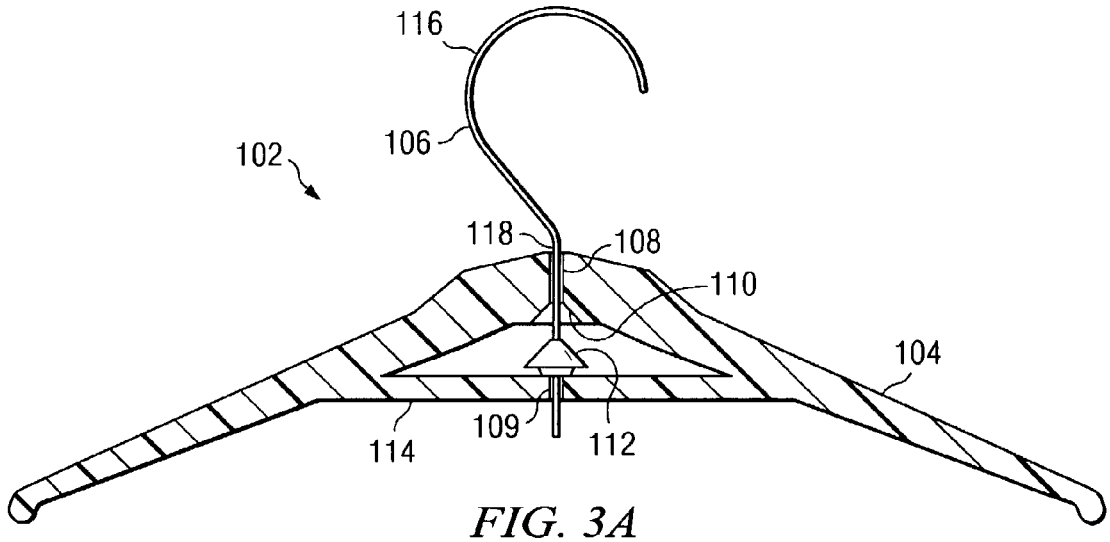
FIG. 3A is a front elevational view of a hanger in an unlocked positioned in accordance with an embodiment of the present invention.
Figure 3B:
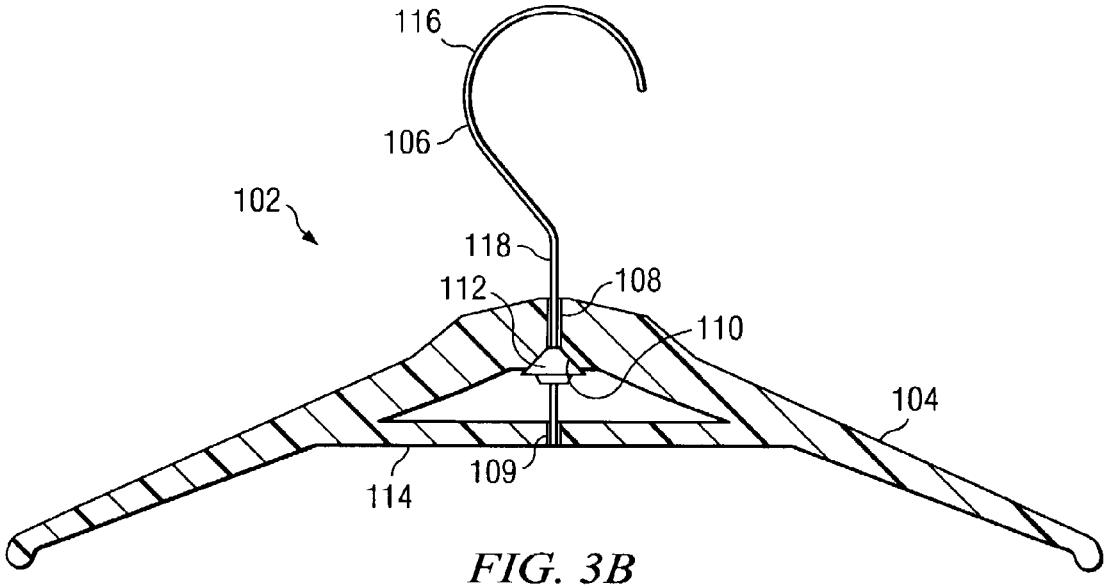
FIG. 3B is a front elevational view of the hanger of FIG. 3A in a locked position.

FIG. 3A is a front elevational view of hanger 102 in an unlocked position in accordance with an embodiment of the present invention and FIG. 3B is a front elevational view of hanger 102 in a locked position. Hanger 102 comprises a main body 104 and a hook 106 coupled to main body 104. Main body 104 may optionally also comprise a support member 114. Main body 104 preferably comprises one or more hook receiving channels 108 and 109. Preferably, each of the hook receiving channels is oriented vertically in main body 104.

Hook 106 preferably comprises of two portions—a top portion 116 and a bottom portion 118. Top portion 116 has a generally curved profile for hanging and holding onto display bar 18. Bottom portion 118 interfaces with main body 104 and may be disposed in upper hook receiving channel 108. Hook 106 is preferably slidably coupled to main body 104. In the unlocked position, hook 106 may be swiveled or rotated 360 degrees. Hook bottom portion 118 comprises an engaging wedge 112. Upper hook receiving channel 108 comprises a receiving cavity 110. In the illustrated embodiment, receiving cavity 110 is located near an end of upper hook receiving channel 108 close to engaging wedge 112. Receiving cavity 110 is preferably adapted or shaped to accommodate engaging wedge 112 such that when engaging wedge 112 is inserted into receiving cavity 110, receiving cavity 110 "locks" engaging wedge 112 in one of a plurality of possible positions and causes hook 106 and main body 104 of hanger 102 to be in the same or different planes. In the locked position, hook 106 is prevented from rotating.

Receiving cavity 110 and engaging wedge 112 may be of any desired shape as long as receiving cavity 110 is capable of receiving at least a portion of engaging wedge 112 and locking hook 106 in at least one of a plurality of positions. A plurality of exemplary shapes for receiving cavity 110 are illustrated in FIGS. 8A, 9A, 10A, 11A, 12A, 13A, 14A and 15A and discussed in greater detail herein with reference to those FIGURES. A plurality of exemplary shapes for engaging wedge 112 are illustrated in FIGS. 8B, 9B, 10B, 11B, 12B, 13B, 14B and 15B and discussed in greater detail herein with reference to those FIGURES.

Engaging wedge 112 may be manually interfaced with receiving cavity 110 by a user to lock hook 106 at a desired angle. Alternatively, when hanger 102 is placed on display bar 18 with an object to be displayed placed on hanger 102, main body 104 of hanger 102 slides downwards at least in part due to the weight of main body 104, thereby causing engaging wedge 112 and receiving cavity 110 to engage and thereby lock hook 106 in one of a plurality of positions.

In order to facilitate the frontal display of objects, it is desirable that hook 106 and main body 104 of hanger 102 be in different planes or be non-coplanar. Because hook 106 may be locked in a plurality of positions, hook 106 of hanger 102 may be locked at different angles with respect to hanger main body 104 thereby allowing hanger 102 to be placed on display bar 18 at an angle. Thus, main body 104 of hanger 102 may be disposed at an angle to the longitudinal axis of display bar 18.

The angle at which main body 104 of hanger 102 is disposed with respect to display bar 18 may be ninety degrees or an angle other than ninety degrees. The angle between the plane of hook 106 and the plane of hanger main body 104 determines the angle at which the object is oriented with respect to display bar 18. The different angles facilitate displaying the objects at different angles and/or orientations. Depending on the angle, when multiple hangers are suspended from the display bar, the objects overlap each other. However, at least a portion of the front of each object is exposed instead of only the sides of the objects.

In an exemplary embodiment, each of the plurality of possible positions cause hook 106 and hanger main body 104 to be in different planes. Thus, when hanger 102 is suspended from a display bar, a plane of hanger main body 104 intersects an axis of the display bar at an angle other than ninety degrees. If desired, in an alternative embodiment, some of the plurality of possible positions cause hook 106 and hanger main body 104 to be in the same plane whereas the remaining ones of the plurality of possible positions cause hook 106 and hanger main body 104 to be in different planes. Thus, depending on the angle at which hook 106 is locked, hook 106 and main body 104 of hanger 102 may be in the same or different planes.

Figure 4:
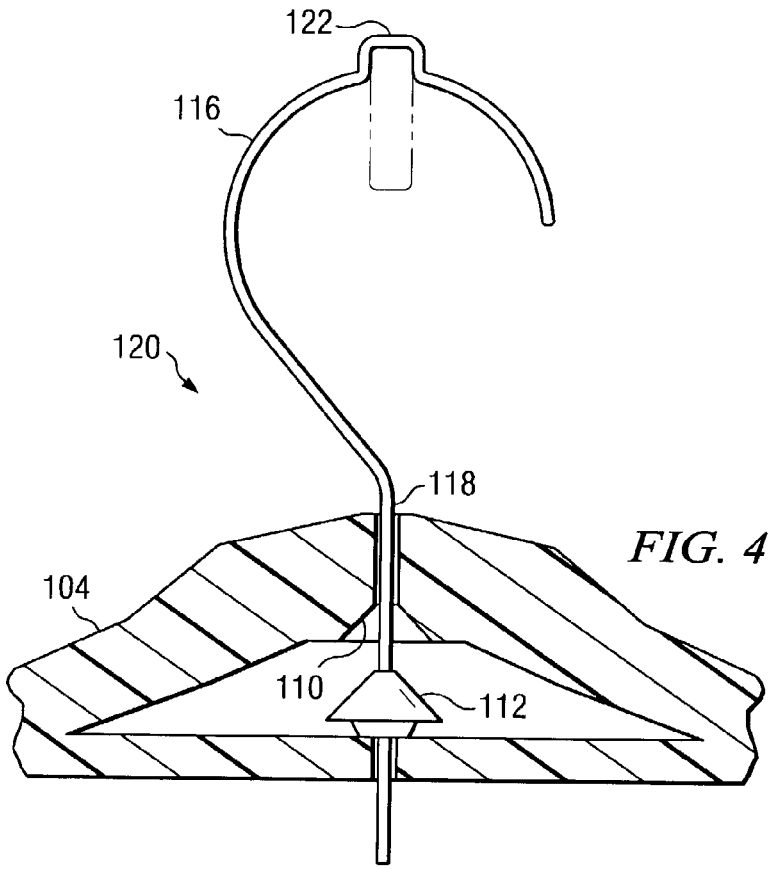
FIG. 4 is a front elevational view of a hook in accordance with an alternative embodiment of the present invention.

FIG. 4 is a front elevational view of a hook 120 in accordance with an alternative embodiment of the present invention. Hook 120 is similar to hook 106 of FIG. 3A. Additionally, hook 120 comprises a notch 122. Notch 122 is preferably disposed on an inside, upper surface of top portion 116 of hook 120. Notch 122 is used to provide stability to hanger 102 such that the hanger would hang vertically from display bar 18 without a tendency to swing or rock. When hanger 102 is hung from a rectangular display bar it interfaces with the display bar at more than one contact point thereby providing more stability to hanger 102.

In an alternative embodiment, if desired, the top portion may comprise of a plurality of discontinuous contact arms as discussed in the above referenced Patent Application with Ser. No. 10/417,060. The configuration of the top hook portion is preferably non-circular. When the hanger is suspended from a display bar, the non-circular configuration of the top portion enables the display bar to contact the top portion of the hook at two or more contact points located on either side of the center of gravity of the hanger. These multiple contact points provide greater stability to the hanger. In its resting position, it is desirable to have the hanger contact the display bar at at least two contact points. The amount of contact at the contact point facilitates the object to come to its natural resting position quickly and with little sway. The actual number of contact points between the top portion and the display bar will vary depending on the diameter of the display bar, the angle between adjacent contact arms, the length of each arm, and/or the like. It is desirable that the resting contact points be located on either side of the center of gravity of hanger 102 so that the object may be displayed on hanger 102 in a stable position. This also facilitates displaying the object facing a desired direction.

Figure 5:
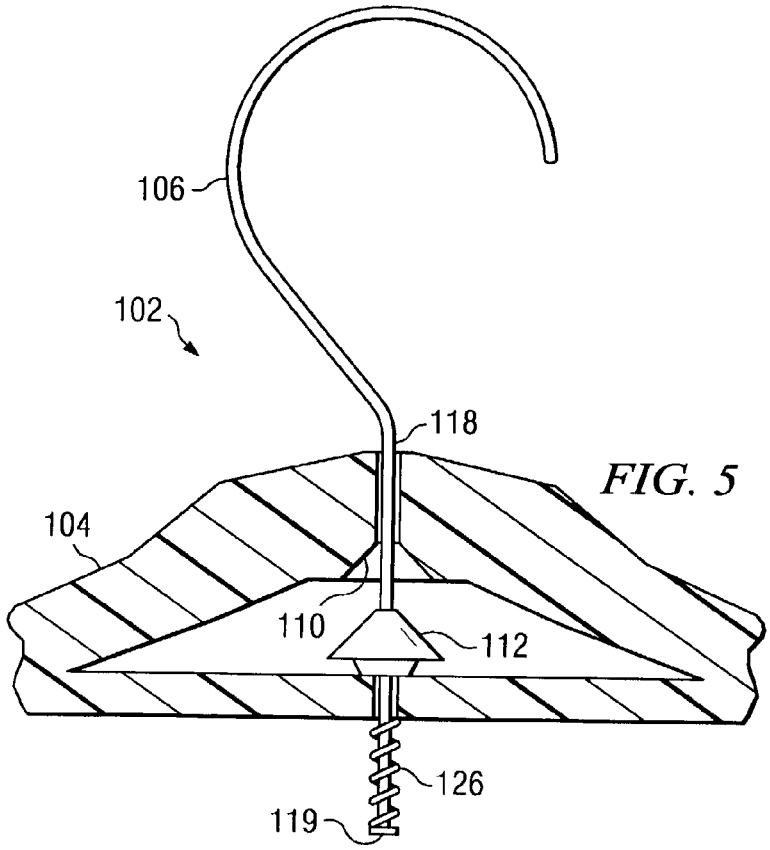
FIG. 5 is a front elevational view of a hanger in accordance with another embodiment of the present invention.

FIG. 5 is a front elevational view of hanger 102 in accordance with another embodiment of the present invention. Hanger 102 of FIG. 5 is similar to hanger 102 of FIGS. 3A and 3B. In the embodiment of FIGS. 3A and 3B, the weight of hook 106 of hanger 102 may not be enough to cause engaging wedge 112 to disengage from receiving cavity 110 when hanger 102 is removed from display bar 14, thereby inadvertently preventing hook 106 from rotating freely. Hanger 102 of FIG. 5 comprises a biasing element 126, such as a spring, to bias hook 106 downwardly to disengage wedge 112 from receiving cavity 110. In FIG. 5, biasing element 126 is disposed around a portion of bottom portion 118 of hook 106 below support member 114 such that biasing element 126 pushes an end 119 of hook 106 away from support member 114. When hanger 102 is placed on display bar 14, the weight of hanger main body 104 compresses biasing element 126 to lock hook 106 in a desired position.

The length of biasing element 126 is such that when it is in its normal uncompressed position, hanger 102 is unlocked. In this position biasing element 126 prevents engaging wedge 112 from interfacing with receiving cavity 110. When hanger 102 is placed on display bar 18, main body 104 of hanger 102 slides downwards on hook 106 at least in part due to the weight of main body 104, thereby causing engaging wedge 112 to enter receiving cavity 110 and to compress biasing element 126. In this position, hook 106 is locked in one of a plurality of positions.

If desired, in an alternative embodiment (not shown), the biasing element may be positioned in between the support member and the engaging wedge to bias the hanger in a locked position with the hook at a desired angle with respect to the main body of the hanger. Engaging wedge 112 may be manually interfaced with receiving cavity 110 by a user to lock hook 106 at a desired angle. If the user desires to change the angle between the hook and the main body, the user can do it manually by disengaging the engaging wedge and the receiving cavity, rotating the hook to the desired angle and then interfacing the engaging wedge and the receiving cavity such that the hook may be locked at a desired angle with respect to the main body of the hanger.

Figure 6:
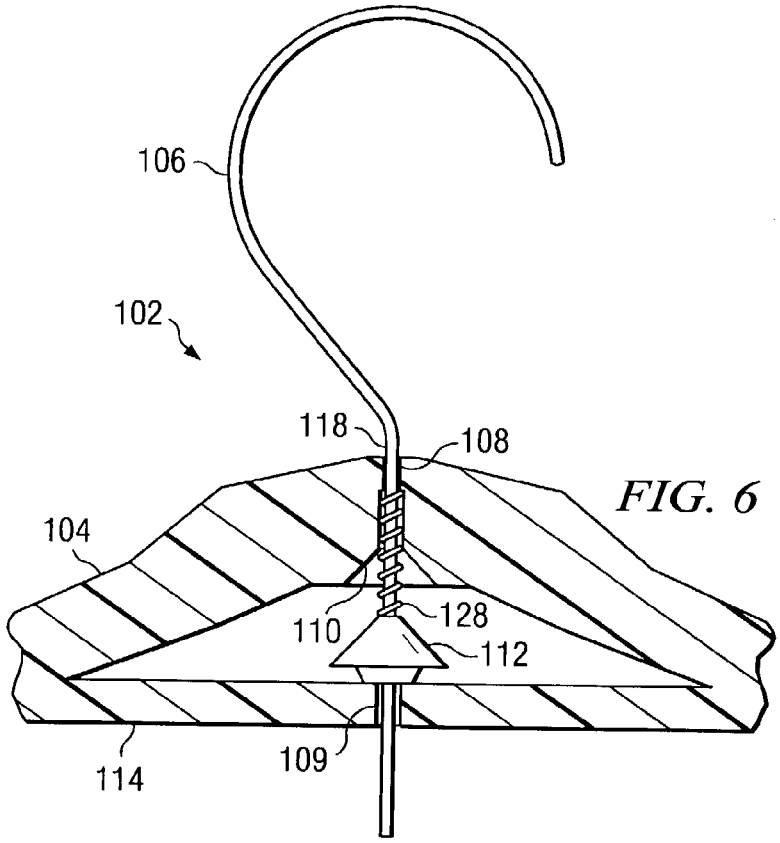
FIG. 6 is a front elevational view of a hanger in accordance with yet another embodiment of the present invention.

FIG. 6 is a front elevational view of hanger 102 in accordance with yet another embodiment of the present invention. Hanger 102 of FIG. 6 is similar to hanger 102 of FIGS. 3A and 3B. In the embodiment of FIGS. 3A and 3B, the weight of hook 106 of hanger 102 may not be enough to cause engaging wedge 112 to disengage from receiving cavity 110 when hanger 102 is removed from display bar 14, thereby inadvertently preventing hook 106 from rotating freely. Hanger 102 of FIG. 6 comprises a biasing element 128, such as a spring, to bias hook 106 downwardly to disengage wedge 112 from receiving cavity 110. In FIG. 6, biasing element 128 is disposed above engaging wedge 112 in upper hook receiving channel 108 such that biasing element 128 pushes an end of engaging wedge 112 away from receiving cavity 110.

The length of biasing element 128 is such that when it is in its normal uncompressed position, hanger 102 is unlocked. In this position, biasing element 128 prevents engaging wedge 112 from interfacing with receiving cavity 110. When hanger 102 is placed on display bar 18, main body 104 of hanger 102 slides downwards on hook 106 at least in part due to the weight of main body 104, thereby causing engaging wedge 112 and receiving cavity 110 to engage and compressing biasing element 128. Hook 106 is thereby locked in one of a plurality of positions.

If desired, in an alternative embodiment (not shown), the biasing element may be positioned along the hook just above the main body of the hanger to bias the hanger in a locked position with the hook at a desired angle with respect to the main body of the hanger. If the user desires to change the angle between the hook and the main body, the user can do it manually by disengaging the engaging wedge and the receiving cavity, rotating the hook to the desired angle and then interfacing the engaging wedge and the receiving cavity such that the hook may be locked at a desired angle with respect to the main body of the hanger.

Figure 7:
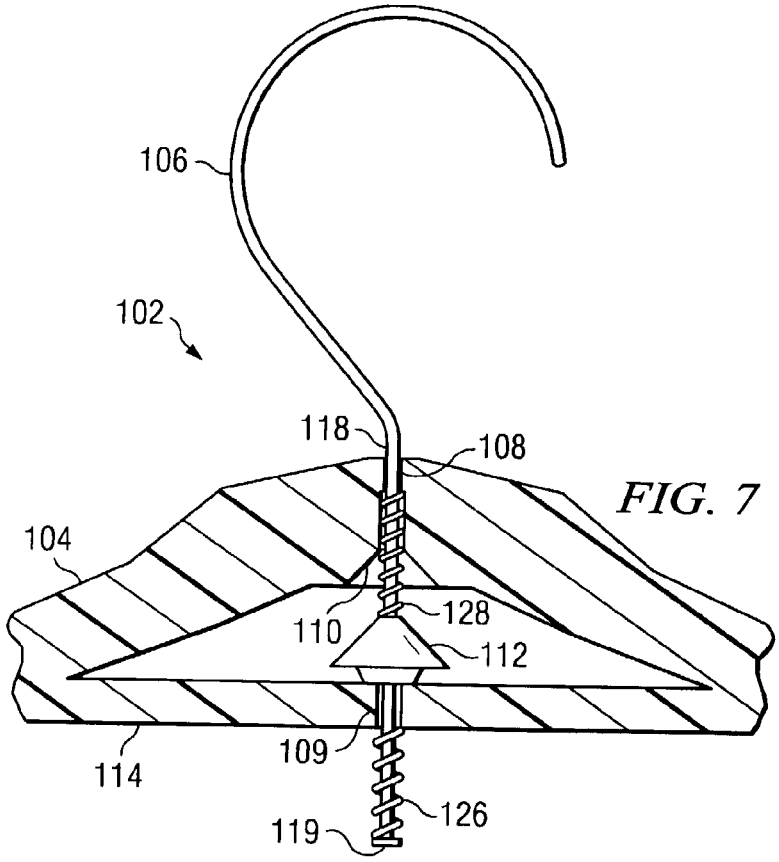
FIG. 7 is a front elevational view of a hanger in accordance with another embodiment of the present invention.

FIG. 7 is a front elevational view of hanger 102 in accordance with another embodiment of the present invention. Hanger 102 of FIG. 7 is similar to hanger 102 of FIGS. 3A and 3B. In the embodiment of FIGS. 3A and 3B, the weight of hook 106 of hanger 102 may not be enough to cause engaging wedge 112 to disengage from receiving cavity 110 when hanger 102 is removed from display bar 14, thereby inadvertently preventing hook 106 from rotating freely. Hanger 102 of FIG. 7 comprises biasing element 126 to bias hook 106 downwardly to disengage wedge 112 from receiving cavity 110. Biasing element 126 by itself may not be able to prevent inadvertent locking of hook 106. As such, if desired, hanger 102 may also comprise second biasing element 128.

When hanger 102 is placed on display bar 18, main body 104 of hanger 102 slides downwards on hook 106 at least in part due to the weight of main body 104, thereby causing engaging wedge 112 and receiving cavity 110 to engage and thereby lock hook 106 in one of a plurality of positions.

If desired, in an alternative embodiment (not shown), the first biasing element may be positioned in between the support member and the engaging wedge to bias the hanger in a locked position with the hook at a desired angle with respect to the main body of the hanger. If desired, in this embodiment, the second biasing element may be positioned along the hook just above the main body of the hanger to further bias the hanger in the locked position. If the user desires to change the angle between the hook and the main body, the user can do it manually by disengaging the engaging wedge and the receiving cavity, rotating the hook to the desired angle and then interfacing the engaging wedge and the receiving cavity such that the hook may be locked at a desired angle with respect to the main body of the hanger.

Figure 8A:
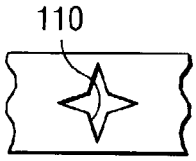
FIGS. 8A and 8B are bottom plan views of a receiving cavity and an engaging wedge in accordance with an embodiment of the present invention.
Figure 8B:
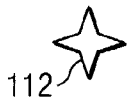

FIGS. 8A and 8B are bottom plan views of receiving cavity 110 and engaging wedge 112 respectively in accordance with an embodiment of the present invention. The cross-section of both receiving cavity 110 and engaging wedge 112 is shaped like a four point star. As such, hook 106 may be locked in four possible positions with respect to main body 104 of hanger 102.

Figure 9A:
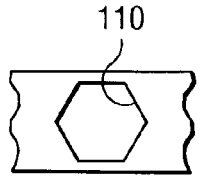
FIGS. 9A and 9B are bottom plan views of a receiving cavity and an engaging wedge respectively in accordance with another embodiment of the present invention.
Figure 9B:
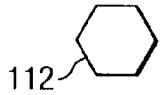

FIGS. 9A and 9B are bottom plan views of receiving cavity 110 and engaging wedge 112 respectively in accordance with another embodiment of the present invention. The cross-sections of both receiving cavity 110 and engaging wedge 112 are hexagonal in shape. As such, hook 106 may be locked in six possible positions with respect to main body 104 of hanger 102.

Figure 10A:
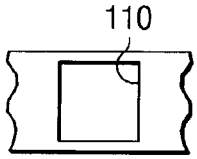
FIGS. 10A and 10B are bottom plan views of a receiving cavity and an engaging wedge respectively in accordance with another embodiment of the present invention.
Figure 10B:
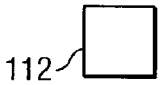

FIGS. 10A and 10B are bottom plan views of receiving cavity 110 and engaging wedge 112 respectively in accordance with another embodiment of the present invention. The cross-sections of both receiving cavity 110 and engaging wedge 112 are square in shape. As such, hook 106 may be locked in four possible positions with respect to main body 104 of hanger 102.

Figure 11A:
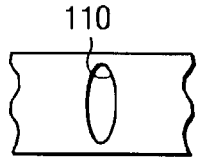
FIGS. 11A and 11B are bottom plan views of a receiving cavity and an engaging wedge respectively in accordance with another embodiment of the present invention.
Figure 11B:
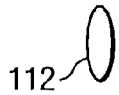

FIGS. 11A and 11B are bottom plan views of receiving cavity 110 and engaging wedge 112 respectively in accordance with another embodiment of the present invention. The cross-sections of both receiving cavity 110 and engaging wedge 112 are elliptical in shape. As such, hook 106 may be locked in two possible positions with respect to main body 104 of hanger 102.

Figure 12A:
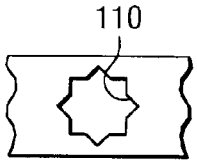
FIGS. 12A and 12B are bottom plan views of a receiving cavity and an engaging wedge respectively in accordance with another embodiment of the present invention.
Figure 12B:
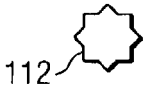

FIGS. 12A and 12B are bottom plan views of receiving cavity 110 and engaging wedge 112 respectively in accordance with another embodiment of the present invention. The cross-section of both receiving cavity 110 and engaging wedge 112 is shaped like and eight point star. As such, hook 106 may be locked in eight possible positions with body 104 of hanger 102.

In the examples of FIGS. 8A, 8B, 9A, 9B, 10A, 10B, 11A, 11B, 12A and 12B, the cross-sections of receiving cavity 110 and engaging wedge 112 correspond to each other in shape. However, it is not necessary that the engaging wedge and the receiving cavity correspond to each other in shape. If desired, the engaging wedge and the receiving cavity may be of different shapes as long as they are capable of interfacing with each other to lock hook 106 in at least one position with respect to main body 104 of hanger 102.

Figure 13A:
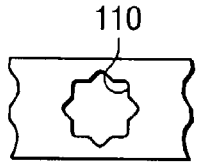
FIGS. 13A and 13B are bottom plan views of a receiving cavity and an engaging wedge respectively in accordance with another embodiment of the present invention.
Figure 13B:
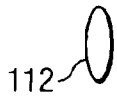

FIGS. 13A and 13B are bottom plan views of receiving cavity 110 and engaging wedge 112 respectively in accordance with another embodiment of the present invention in which the shape of the cross-sections of receiving cavity 110 and engaging wedge 112 are different. The shape of the cross-section of receiving cavity 110 is similar to that of an eight point star. The shape of the cross-section of engaging wedge 112 is elliptical. Because of the shapes of receiving cavity 110 and engaging wedge 112, hook 106 may be locked in eight possible positions with respect to main body 104 of hanger 102.

The overall outside shape of engaging wedge 112 and the overall inside shape of receiving cavity 110 may be of any shape. It is desirable that the top portion of engaging wedge 112 be at least slightly smaller than the bottom portion of receiving cavity 110 to facilitate insertion of engaging wedge 112 in receiving cavity 110. Preferably, engaging wedge 112 tapers towards the top such that the overall outside shape of engaging wedge 112 is conical. Preferably, receiving cavity 110 also tapers towards the top such that the overall inside shape of receiving cavity 110 is like that of a frustum. The advantage of having an overall conical shape for the engaging wedge and an overall frustum shape for the receiving cavity is that it facilitates interfacing of the engaging wedge with the receiving cavity as it is easier to insert the top of the engaging wedge into the bottom of the receiving cavity. The overall shape also facilitates a snug fit between the receiving cavity and the engaging wedge.

Figure 14A:
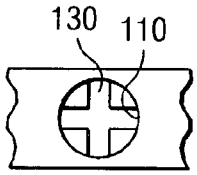
FIG. 14A is a bottom plan view of a receiving cavity in accordance with another embodiment of the present invention.
Figure 14B:
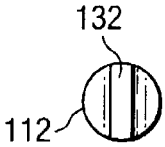
FIG. 14B is a top plan view of an engaging wedge in accordance with another embodiment of the present invention.

FIG. 14A is a bottom plan view of receiving cavity 110 in accordance with another embodiment of the present invention and FIG. 14B is a top plan view of engaging wedge 112 in accordance with another embodiment of the present invention. Engaging wedge 112 of FIG. 14A is shaped like a cylinder with an engaging portion 132 projecting from it at the end close to receiving cavity 110. Receiving cavity 110 includes one or more slots 130 into which engaging portion 132 of engaging wedge 112 may be inserted for locking hook 106 in one of four possible positions with respect to main body 104 of hanger 102.

Figure 15A:
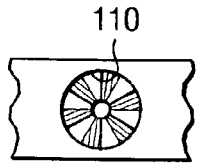
FIG. 15A is a bottom plan view of a receiving cavity in accordance with another embodiment of the present invention.
Figure 15B:
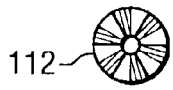
FIG. 15B is a top plan view of an engaging wedge in accordance with another embodiment of the present invention.

FIG. 15A is a bottom plan view of receiving cavity 110 in accordance with another embodiment of the present invention and FIG. 15B is a top plan view of engaging wedge 112 in accordance with another embodiment of the present invention. Engaging wedge 112 of FIG. 15A is shaped like a crown. Receiving cavity 110 is shaped to engage with engaging wedge 112 to lock hook 106 in one of a plurality of possible positions with respect to main body 104 of hanger 102.

During shipping it is desirable that the hanger main body be at a ninety degree angle with respect to the display bar, while during display some retailers desire that the hanger main body be at an angle other than ninety degrees with respect to the display bar, whereas other retailers desire that the hanger main body be at a ninety degree angle with respect to the display bar. In accordance with an embodiment of the present invention, because the engaging wedge may be locked in a plurality of positions, the main body of the same hanger may be placed at a ninety degree angle with respect to the display bar or at an angle other than ninety degrees with respect to the display bar depending on the application.

In a conventional hanger without a swivel hook, if the user inadvertently places the object on the hanger in such a way that when the hanger is placed on the display bar the front of the object faces the wrong direction, the user has to remove the object and place it back on the hanger so that the front of the object would face a desired direction. A conventional hanger with a swivel hook allows the object to be placed on the display bar with the front of the object facing in the desired direction irrespective of the manner in which the object is placed on the main body of the hanger. However, a conventional hanger with a swivel hook does not allow frontal display of multiple objects along a uniformly horizontal display bar.

The advantage of a hanger in accordance with an exemplary embodiment of the present invention is that it allows an object to be displayed with the front of the object always facing the desired direction. For example, if the user places the object on the hanger with the front of the object facing the wrong direction, the hanger may still be placed on the display bar in a manner that would allow the front of the object to face the desired direction. By simply disengaging the engaging wedge from the receiving cavity, turning the hook around to a desired angle and placing the hanger on the display bar, the user can display the object hanging from the display bar such that the front of the object is facing the right direction. Furthermore, the hanger in accordance with an exemplary embodiment of the present invention allows frontal display of the objects along a uniformly horizontal display bar.

An advantage of an exemplary embodiment of the present invention is that it allows simultaneous viewing of the colors, styles, patterns and/or other attributes of the displayed objects. Moreover, the fronts of the objects are still visible even when the objects are tightly packed together on the display bar. Another advantage of an exemplary embodiment is that it allows for faster and easier searching of objects with the right size, color, style, and pattern. Another advantage of an exemplary embodiment is that a greater portion of the front of the object is displayed. Yet another advantage of an exemplary embodiment is that closets or display cases that are narrower than the width of the hanger may be used.

While the invention has been particularly shown and described by the foregoing detailed description, it will be understood by those skilled in the art that various other changes in form and detail may be made without departing from the spirit and scope of the invention.

What is claimed is:

1. A hanger, comprising:

a main body having a hook-receiving channel therethrough, the hook-receiving channel further comprising an enlarged end having a predetermined shape; and a swivel hook having an elongated straight portion disposed in the hook-receiving channel, the swivel hook further comprising an engaging wedge having a cross-sectional shape comprising angular corners and operable to engage the predetermined shape of the enlarged end of the hook-receiving channel and lock the main body in one of a plurality of predetermined planar relationship with the swivel hook.

2. The hanger of claim 1, further comprising a biasing element operable to bias the swivel hook to disengage the engaging wedge from the enlarged end of the hook-receiving channel and unlock the main body and the swivel hook from the locked planar relationship.

3. The hanger of claim 2, wherein the biasing element is disposed at least partially within the hook-receiving channel and operable to push the engaging wedge out of the enlarged end of the hook receiving channel and maintain the main body and swivel hook in an unlocked position.

4. The hanger of claim 3, further comprising a second biasing element disposed about the elongated straight portion of the swivel hook and operable to pull the engaging wedge out of the enlarged end of the hook-receiving channel and maintain the main body and swivel hook in an unlocked position.

5. The hanger of claim 3, further comprising a second biasing element disposed about the elongated straight portion of the swivel hook and operable to bias the engaging wedge into the enlarged end of the hook-receiving channel.

6. The hanger of claim 1, wherein the engaging wedge is operable to self-engage and re-self-engage the predetermined shape of the enlarged end of the hook-receiving channel and self-lock and re-self-lock the main body in one of a plurality of predetermined planar relationship with the swivel hook after the engaging wedge has been disengaged from the enlarged end of the hook-receiving channel.

7. The hanger of claim 6, wherein a weight of the main body is operable to overcome the biasing element and engage the engaging wedge with the enlarged end of the hook receiving channel and lock the main body in one of the plurality of predetermined planar relationship with the swivel book.

8. The hanger of claim 6, wherein a weight of an object hung on the main body is operable to overcome the biasing element and engage the engaging wedge with the enlarged end of the hook receiving channel and lock the main body in one of the plurality of predetermined planar relationship with the swivel hook.

9. The hanger of claim 1, wherein the plurality of predetermined locked planar relationship comprise non-coplanar and coplanar relationships between the swivel hook and the main body.

10. The hanger of claim 1, wherein the plurality of predetermined locked planar relationship comprises at least one planar relationship where the main body lies in a first plane and the swivel hook lies in a second plane, and the first plane intersecting the second plane at an angle other than 0 degrees.

11. The hanger of claim 1, wherein the cross-sectional shape of the engaging wedge is selected from the group consisting of a star, a hexagon, a pentagon, an octagon, a triangle, a square, a crown and an ellipse.

12. The hanger of claim 1, wherein the cross-sectional shape of the enlarged end of the hook-receiving channel is selected from the group consisting of a star, a hexagon, a pentagon, an octagon, a triangle, a square, a crown and an ellipse.

13. The hanger of claim 1, wherein the main body further comprises at least one slot operable to display a removable information tag.

14. A display system, comprising:

a display bar; and a plurality of hangers suspended from the display bar, at least one of the hangers comprises:

a main body having a hook-receiving channel therethrough, the hook-receiving channel further comprising an enlarged end having a predetermined non-circular cross-sectional shape;

a swivel hook having an elongated straight portion disposed in the hook-receiving channel, the swivel hook further comprising an engaging wedge having a cross-sectional shape operable to self-engage the enlarged end of the hook-receiving channel and lock the main body in one of a plurality of predetermined planar relationship with the swivel hook; and a biasing element operable to bias the swivel hook to disengage the engaging wedge from the enlarged end of the hook receiving channel and unlock the main body and the swivel hook from the locked planar relationship.

15. The display system of claim 14, wherein the plurality of predetermined locked planar relationship comprise non-coplanar and coplanar relationships between the swivel hook and the main body.

16. The display system of claim 14, wherein a weight of the main body is operable to overcome the biasing element and engage the engaging wedge with the enlarged end of the hook receiving channel and lock the main body in one of the plurality of predetermined planar relationship with the swivel hook.

17. The display system of claim 14, wherein a weight of an object hung on the main body is operable to overcome the biasing element and engage the engaging wedge with the enlarged end of the hook-receiving channel and lock the main body in one of the plurality of predetermined planar relationship with the swivel hook.

18. The hanger of claim 14, wherein the plurality of predetermined locked planar relationship comprises at least one planar relationship where the main body lies in a first plane and the swivel hook lies in a second plane, and the first plane intersecting the second plane at an angle other than 0 degrees.

19. The hanger of claim 14, wherein the biasing element is disposed at least partially within the hook receiving channel and operable to push the engaging wedge out of the enlarged end of the hook receiving channel and maintain the main body and swivel hook in an unlocked position.

20. The hanger of claim 14, further comprising a second biasing element disposed about the elongated straight portion of the swivel hook and operable to pull the engaging wedge out of the enlarged end of the hook receiving channel and maintain the main body and swivel hook in an unlocked position.

21. The hanger of claim 14, further comprising a second biasing element disposed about the elongated straight portion of the swivel hook and operable to bias the engaging wedge into the enlarged end of the hook receiving channel.

22. The hanger of claim 14, wherein the cross-sectional shape of the hook-receiving channel comprises angular corners.

23. The hanger of claim 14, wherein a cross-sectional shape of the engaging wedge is selected from the group consisting of a star, a triangle, a pentagon, a hexagon, an octagon, a square, a crown and an ellipse.

24. The hanger of claim 14, wherein a cross-sectional shape of the enlarged end of the hook receiving channel is selected from the group consisting of a star, a pentagon, a hexagon, an octagon, a square, a crown and an ellipse.

25. The hanger of claim 14, wherein the main body further comprises at least one slot operable to display a removable information tag.

26. A hanger, comprising:

a hanger body having a hook-receiving channel therethrough, the hook-receiving channel further comprising an enlarged end having a predetermined angular cross-sectional shape; and a swivel hook having an elongated straight portion disposed in the hook-receiving channel, the swivel hook further comprising an engaging wedge having a cross-sectional shape operable to self-engage the enlarged end of the hook-receiving channel and disengageably lock and re-lock the hanger body in one of a plurality of predetermined angular relationship with the swivel hook due to the weight of the hanger body.

27. The hanger of claim 26, further comprising a biasing element operable to bias the swivel hook to disengage the engaging wedge from the enlarged end of the hook-receiving channel and unlock the hanger body and the swivel hook from the locked angular relationship.

28. The hanger of claim 27, wherein the biasing element is disposed at least partially within the hook-receiving channel and operable to push the engaging wedge out of the enlarged end of the hook-receiving channel and maintain the hanger body and swivel hook in an unlocked position.

29. The hanger of claim 28, further comprising a second biasing element disposed about the elongated straight portion of the swivel hook and operable to pull the engaging wedge out of the enlarged end of the hook-receiving channel and maintain the hanger body and swivel hook in an unlocked position.

30. The hanger of claim 28, further comprising a second biasing element disposed about the elongated straight portion of the swivel hook and operable to bias the engaging wedge into the enlarged end of the hook receiving channel.

31. The hanger of claim 26, wherein a weight of an object hung on the hanger body is operable to overcome the biasing element and engage the engaging wedge with the enlarged end of the hook-receiving channel and lock the hanger body in one of the plurality of predetermined angular relationship with the swivel hook.

32. The hanger of claim 26, wherein the plurality of predetermined locked angular relationship comprises at least one angular relationship where the hanger body lies in a first plane and the swivel hook lies in a second plane, and the first plane intersecting the second plane at a angle other than 0 degrees.

33. The hanger of claim 26, wherein the cross-sectional shape of the engaging wedge is selected from the group consisting of a star, a triangle, a pentagon, a hexagon, an octagon, a square, a crown and an ellipse.

34. The hanger of claim 26, wherein the cross-sectional shape of the enlarged end of the hook receiving channel is selected from the group consisting of a star, a triangle, a pentagon, a hexagon, an octagon, a square, a crown and an ellipse.

35. The hanger of claim 26, wherein the hanger body further comprises at least one slot operable to display a removable information tag.

* * * * *